US011584568B2

(12) United States Patent
Johnston

(10) Patent No.: US 11,584,568 B2
(45) **Date of Patent: *Feb. 21, 2023**

(54) RESEALABLE BAG

(71) Applicant: BAGEM PACKAGING SERVICES, INC., Toronto (CA)

(72) Inventor: Glenn Johnston, Toronto (CA)

(73) Assignee: BAGEM PACKAGING SERVICES INC., Toronto (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/021,568

(22) Filed: Sep. 15, 2020

(65) Prior Publication Data

US 2020/0407121 A1 Dec. 31, 2020

Related U.S. Application Data

(63) Continuation of application No. 16/553,961, filed on Aug. 28, 2019, now abandoned, which is a (Continued)

(51) Int. Cl.
*B65D 33/25* (2006.01)
*B65D 33/20* (2006.01)

(52) U.S. Cl.
CPC ..... *B65D 33/2508* (2013.01); *B65D 33/20* (2013.01); *B65D 2215/02* (2013.01)

(58) Field of Classification Search
CPC . B65D 33/2508; B65D 33/20; B65D 2215/02
(Continued)

(56) References Cited

U.S. PATENT DOCUMENTS 2,916,197 A 12/1959 Detrie et al.
4,430,070 A * 2/1984 Ausnit ..... B29C 66/1122 493/215

(Continued)

FOREIGN PATENT DOCUMENTS

JP 2002337891 A 11/2002
JP 2011140326 A 7/2011

(Continued)

OTHER PUBLICATIONS

PCT/CA2017/050518 International Search Report Completed Jul. 13, 2017.

(Continued)

*Primary Examiner* — Jes F Pascua
(74) *Attorney, Agent, or Firm* — Tarolli, Sundheim, Covell & Tummino LLP

(57) ABSTRACT

A bag has a recloseable fastener, a bottom and, for each side, a flap. The flap has side edges that are sealed to side edges of the bag, the flap being sized and dimensioned such that the flap lies flush against the side of the bag except when stretched or drawn apart therefrom, the flap being disposed intermediate the recloseable fastener and the bottom. The fastener is adapted such that the amount of force necessary to separate the components, when such force is applied to interiors of the walls at a position between the fastener and the bottom and adjacent the fastener, is greatly exceed by the amount of force necessary to separate the components: when such force is applied to the walls adjacent the upper edge; and when such force is applied to the free edges of the flaps. The bag can be produced either on a pouch machine or a sideweld bag machine. A single web can be fed over a series of rollers and formers to make progressive folds and a zipper closure can be continuously fed to the inner side of the structure and sealed in place. Side seals are made intermittently to finish the bag. The seal on a sideweld version can (Continued)

be a bead seam whereas on the pouch machine the seal can be up to ¼" wide.

6 Claims, 13 Drawing Sheets

Related U.S. Application Data continuation of application No. 15/813,697, filed on Nov. 15, 2017, now Pat. No. 10,427,839, which is a continuation-in-part of application No. PCT/CA2017/050518, filed on Apr. 28, 2017.

(60) Provisional application No. 62/382,818, filed on Sep. 2, 2016, provisional application No. 62/329,433, filed on Apr. 29, 2016.

(58) Field of Classification Search
USPC ..... 383/63, 65
See application file for complete search history.

(56) References Cited

U.S. PATENT DOCUMENTS

| | | | | |
|---|---|---|---|---|
| 4,619,021 | A * | 10/1986 | Johnson | B65D 33/2541 206/274 |
| 4,807,300 | A | 2/1989 | Ausnit et al. | |
| 4,812,074 | A * | 3/1989 | Ausnit | B65B 61/188 156/204 |
| 4,878,763 | A * | 11/1989 | Ausnit | B65D 33/2508 24/585.12 |
| 4,912,616 | A | 3/1990 | Van Erden | |
| 5,902,047 | A * | 5/1999 | Yeager | B65D 33/2533 383/203 |
| 6,609,998 | B2 * | 8/2003 | Lauzon | B31B 70/00 493/212 |
| 7,419,300 | B2 | 9/2008 | Pawloski et al. | |
| 7,914,208 | B2 * | 3/2011 | Sprehe | B65D 33/2541 24/30.5 R |
| 10,011,403 | B1 | 7/2018 | Kirsh | |
| 10,011,404 | B1 | 7/2018 | Kirsh | |
| 10,427,839 | B2 | 10/2019 | Johnston | |
| 2006/0093242 | A1 * | 5/2006 | Anzini | B65D 33/2508 383/63 |
| 2019/0315524 | A1 * | 10/2019 | Huang | B65D 33/2508 |

FOREIGN PATENT DOCUMENTS

| | | | |
|---|---|---|---|
| JP | 2016098330 | A | 5/2016 |
| JP | 2017210258 | A | 11/2017 |
| WO | 0204307 | | 1/2002 |
| WO | 2014066025 | | 5/2014 |
| WO | 2017051835 | A1 | 3/2017 |

OTHER PUBLICATIONS

PCT/CA2017/050518 International Preliminary Report on Patentability—dated Oct. 30, 2018.

* cited by examiner

RESEALABLE BAG

RELATED APPLICATION

This application is a Continuation-in-Part of U.S. patent application Ser. No. 16/553,961, filed Aug. 28, 2019, which is a Continuation of U.S. patent application Ser. No. 15/813,697, filed Nov. 15, 2107 (U.S. Pat. No. 10,427,839; issued Oct. 1, 2019), which is a Continuation-in-Part of International Patent Appln. PCT/CA2017/050518, filed Apr. 28, 2017 and claims priority to U.S. Provisional Patent Appln. No. 62/329,433, filed Apr. 29, 2016 and U.S. Provisional Patent Appln. No. 62/382,818, filed Sep. 2, 2016, the entirety of which are incorporated herein by reference.

FIELD OF THE INVENTION

The invention relates to the field of drug packaging.

BACKGROUND OF THE INVENTION

Known packaging is either relatively expensive to produce or unsuitable for use with drugs.

SUMMARY OF THE INVENTION

Forming one aspect of the invention is an improved resealable bag of the type having:

a pair of walls, each defining a side of the bag, the walls being joined to one another to define a pair of spaced apart side edges of the bag between which side edges the walls each extend, a bottom from which the walls extend and an upper edge to which the walls extend;

for each of the walls and operatively secured thereto, proximal to and spaced from the upper edge, a component, the components mating with one another to define a recloseable press-to-seal fastener.

The improvement comprises:

for each side of the bag, a flap, the flap having side edges that are sealed to the side edges of the bag, the flap being sized and dimensioned such that the flap lies flush against the side of the bag except when stretched or drawn apart therefrom, the flap being disposed intermediate the recloseable fastener and the bottom; and the fastener being adapted such that the amount of force necessary to separate the components, when such force is applied to interiors of the walls at a position between the fastener and the bottom and adjacent the fastener, is greatly exceed by the amount of force necessary to separate the components: (i) when such force is applied to the walls adjacent the upper edge; and (ii) when such force is applied to the free edges of the flaps.

According to another aspect of the invention, the bag can be adapted such that, when the bag is occluded by the closure, application of force to the interiors of the walls, at said position between the fastener and the bottom and adjacent the fastener, requires portions of the wall to be doubled up.

According to another aspect of the invention, the walls can be constructed of material that is relatively stretch-resistant and the bag is constructed such that said portions of the wall cannot be doubled up as aforesaid without substantial stretching of the bag.

According to another aspect of the invention, the bag can further comprise, for each wall of the bag, a strip, the strip extending between the side edges of the bag and having a pair of edges, each edge extending between the side edges of the bag and being secured to the wall.

According to another aspect of the invention, each component can be secured to the wall for which it is provided by attachment to the strip provided for said each wall, the component being disposed in offset relation between the edges of the strip such that it is further from the edge of the strip that is nearest to the bag bottom.

According to another aspect of the invention, each component can have a pair of hooks and a barrier, one of the components being arranged such that the barrier lies between the hooks and the upper edge and such that the hooks open towards the upper edge;

the other of the components being arranged such that the hooks lie between the barrier and the upper edge and such that the hooks open away from the upper edge, the hooks and barriers being shaped and dimensioned such that, when the components are mated, to occlude the bag, (i) the spaces between the hooks and the barrier of the one component are substantially occupied by the hooks of the other component, and (ii) the spaces between the hooks and the barrier of the other component and substantially occupied by the hooks of the one component.

According to another aspect of the invention, one of the components can be secured to the strip by a flange, the components being shaped and dimensioned such that, when the components are mated, to occlude the bag, a majority of the components are positioned between the flange and the upper edge.

According to still another aspect of the invention, the bag can be constructed in a variety of ways. For example, the bag can be produced either on a pouch machine or a sideweld bag machine. A single web can be fed over a series of rollers and formers to make progressive folds and a zipper closure can be continuously fed to the inner side of the structure and sealed in place. Side seals are made intermittently to finish the bag. The seal on a sideweld version can be a bead seam whereas on the pouch machine the seal can be up to ¼" wide.

Advantages, details and characteristics of the present invention will become apparent upon a review of the following detailed description with reference to the appended drawings, the latter being described briefly hereinafter.

Figure 5:
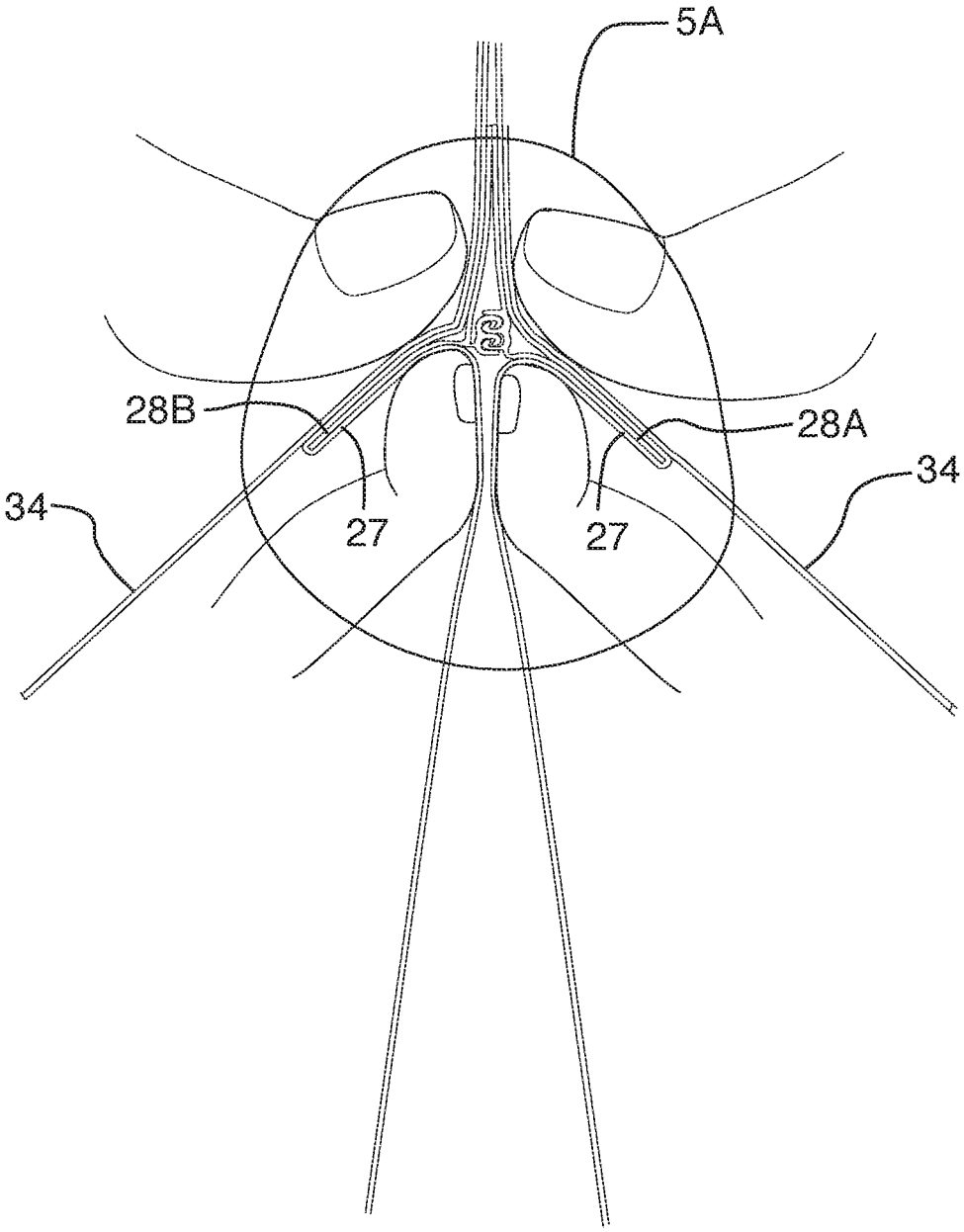
FIG. 5 is a view similar to FIG. 4 showing thumbs inserted beneath the flaps to duble up the walls.
Figure 5A:
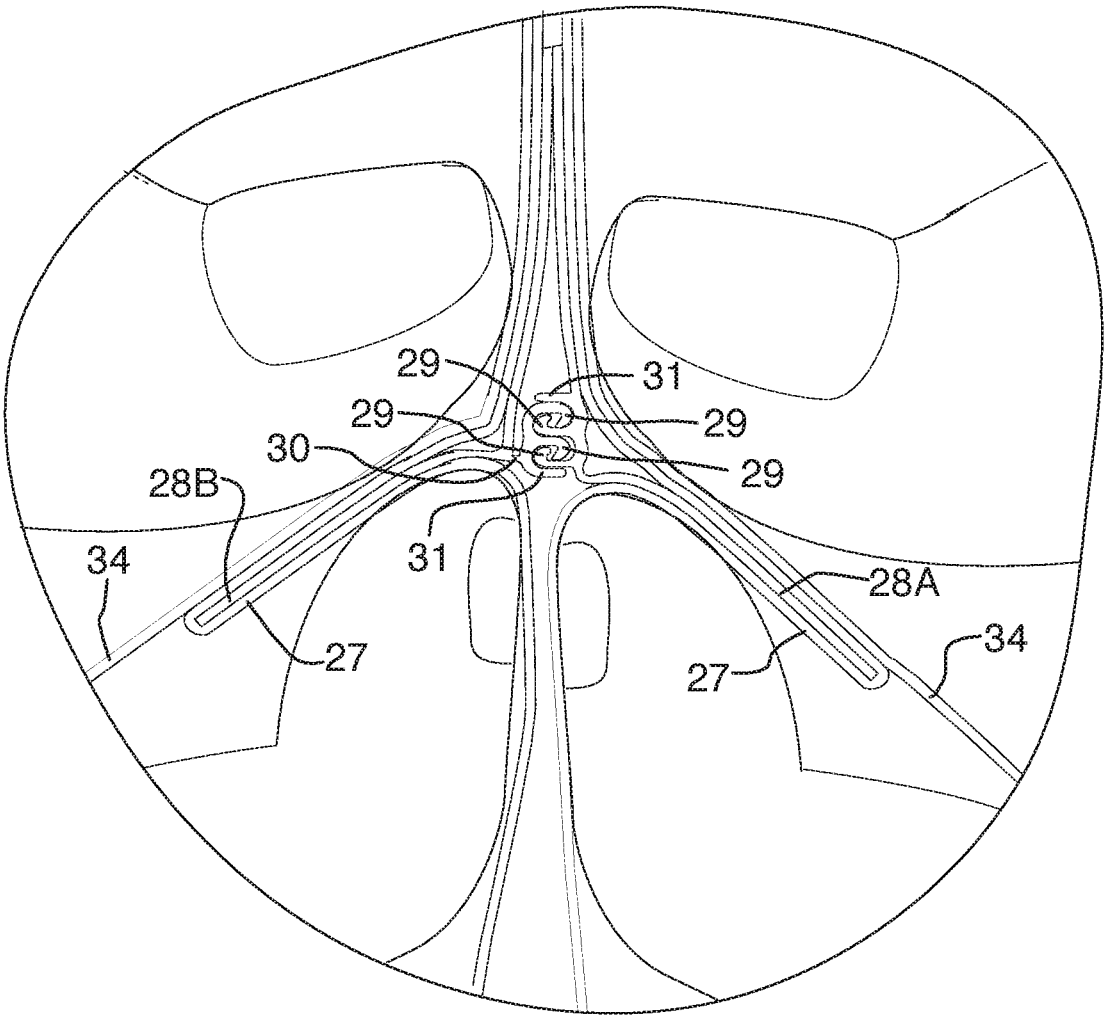
FIG. 5A is an enlarged view of encircled area 5A of FIG. 5; F
Figure 6:
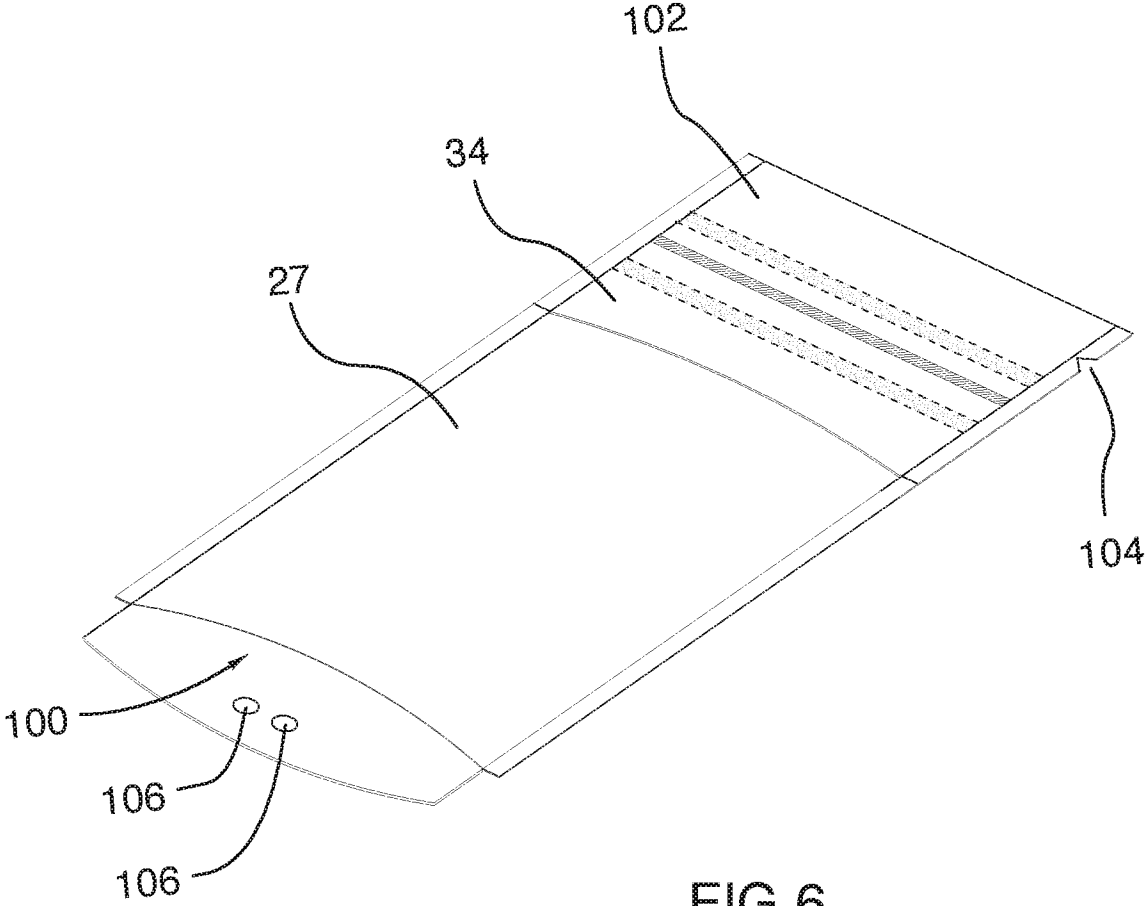
Figure 7:
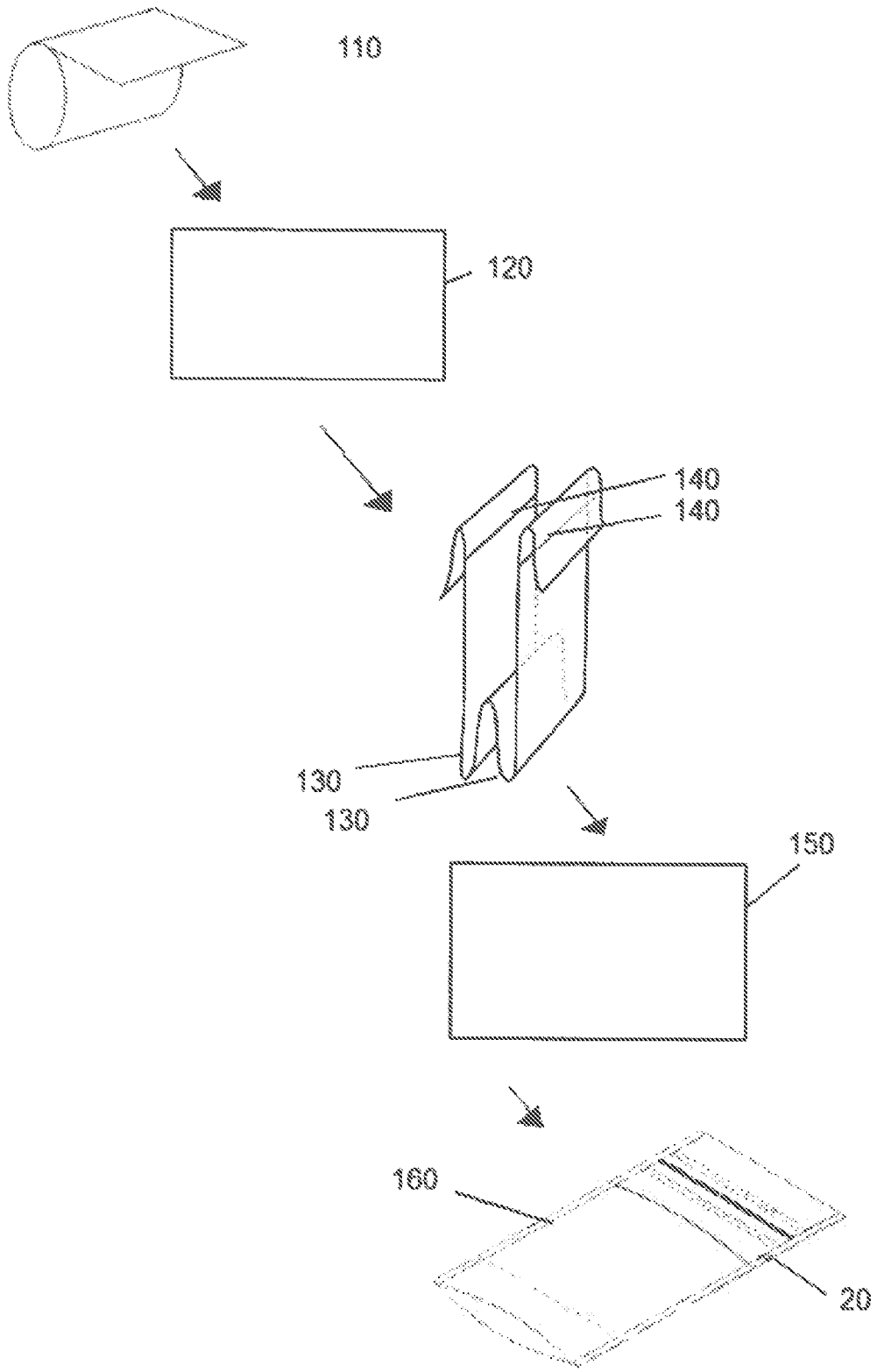

IG. 5B is a view similar to FIG. 5A showing the components of the closure separated from one another;

FIG. 6 is a perspective view of a bag constructed according to another exemplary embodiment of the invention;

FIG. 7 is a schematic view of an example method of production.

Resealable Pouch

Figure 1:
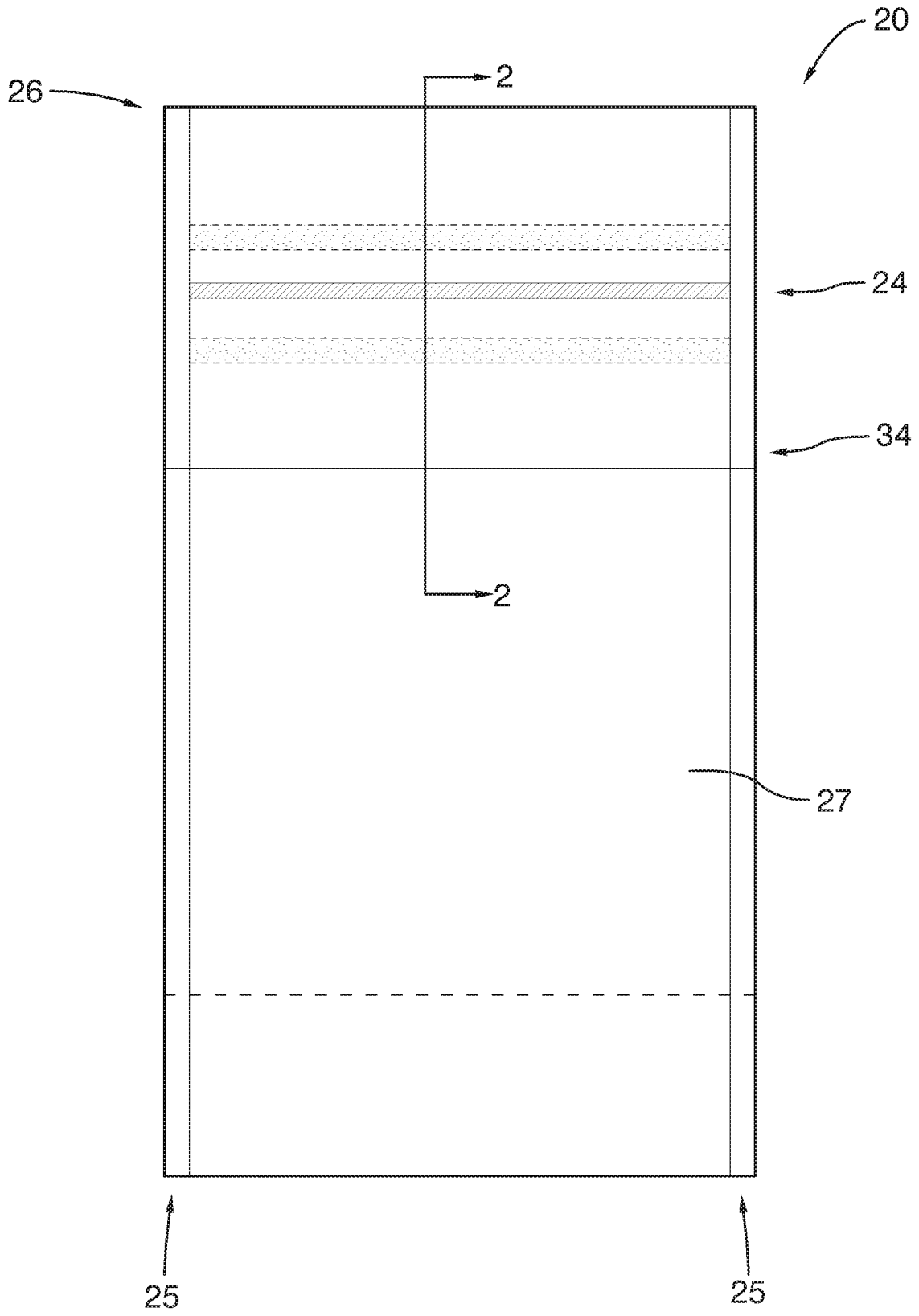
FIG. 1 is a side view of a bag according to an exemplary embodiment of the invention.
Figure 1A:
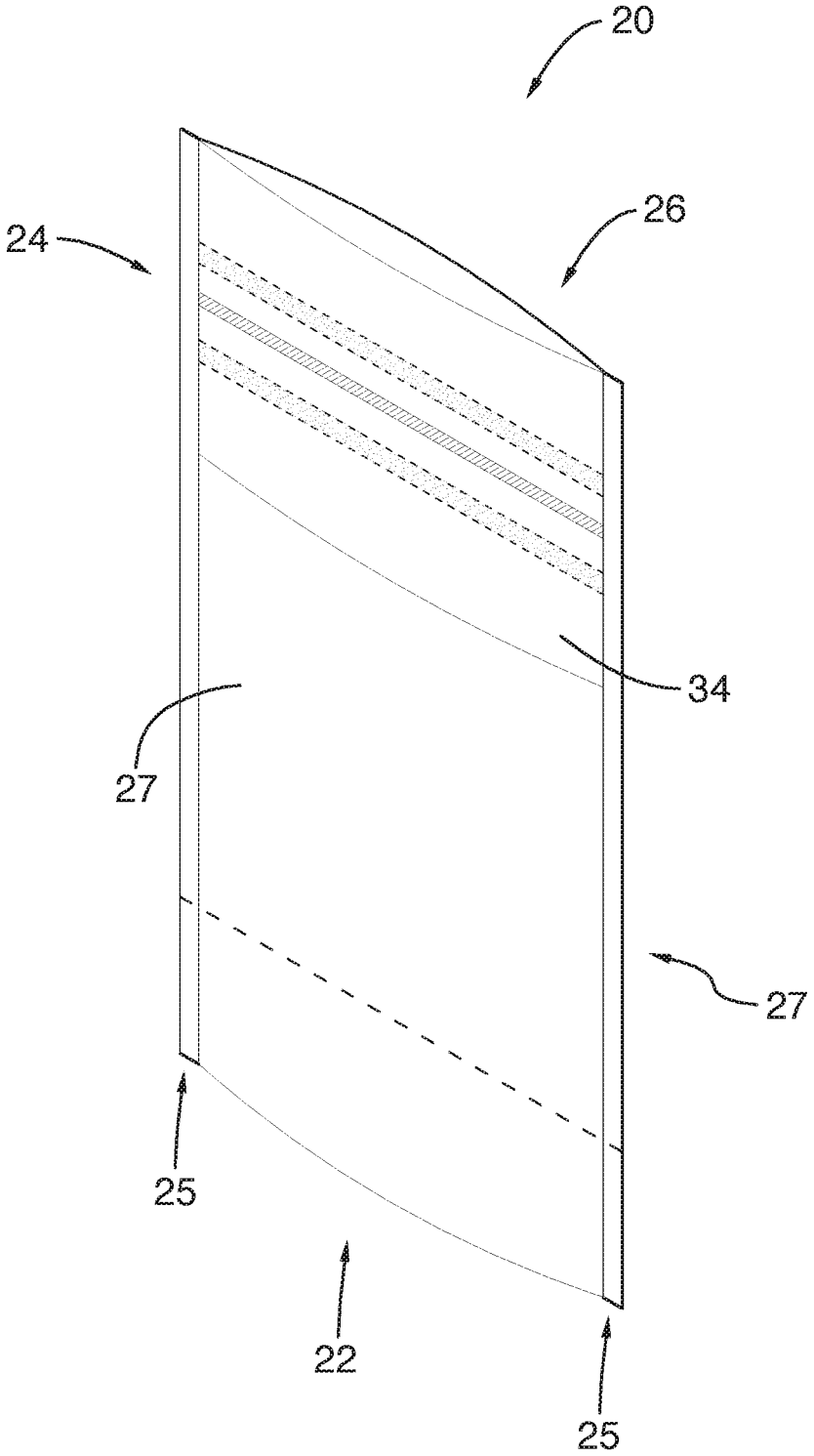
FIG. 1A is a perspective view of the bag of FIG. 1.
Figure 1B:
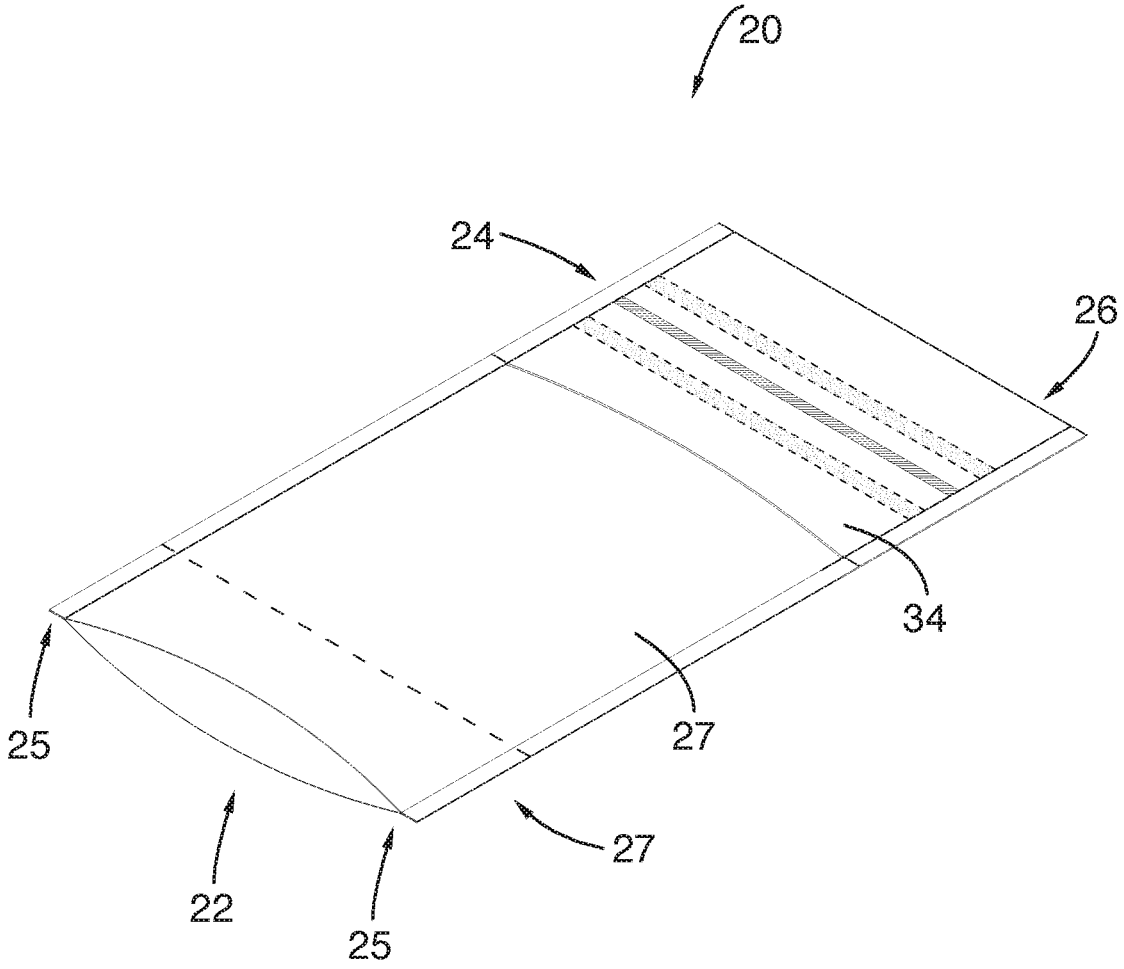
FIG. 1B is a perspective view of the bag of FIG. 1.

The bag 20 is shown in FIGS. 1-5B and will be understood to be of the stand up pouch type having a gusseted bottom 22. FIG. 1 shows the bag laid flat. FIG. 1B shows the bottom 22 of the bag spread apart for use.

The bag 20 will be seen to be of the type having:

a pair of walls 27, each defining a side of the bag, the walls being joined to one another to define a pair of spaced apart side edges 25 of the bag between which side edges the walls each extend, the bottom 22, from which the walls extend and an upper edge 26 to which the walls extend;

for each of the walls 27 and operatively secured thereto, proximal to and spaced from the upper edge, a component 24A, 24B the components mating with one another to define a recloseable press-to-seal fastener 24.

The recloseable fastener 24 is disposed proximal to the upper edge 26 of the bag. The components 24A, 24B are each secured to a respective strip 28A, 28B which in turn are secured to the walls 27 of the bag. One of the components 24B is secured to its respective strip 28B by a flange 30. The components 24A, 24B are offset in their respective strips towards the upper edge 26 of the bag, so as to render the components more susceptible to pivotal movement relative to the bag walls in one direction than the other.

Each component has a pair of hooks 29 and a barrier 30, one of the components 24A being arranged such that the barrier lies between the hooks and the upper edge and such that the hooks open towards the upper edge;

the other of the components 24B being arranged such that the hooks lie between the barrier and the upper edge and such that the hooks open away from the upper edge, the hooks and barriers being shaped and dimensioned such that, when the components are mated, to occlude the bag, (i) the spaces between the hooks and the barrier of the one component are substantially occupied by the hooks of the other component, and (ii) the spaces between the hooks and the barrier of the other component and substantially occupied by the hooks of the one component.

A pair of flaps 34 are formed on the sides of the bag, intermediate the recloseable fastener 24 and the bottom 22. The side edges of the flaps are sealed to the side edges of the bag, such that flaps 34 lie substantially flush against the sides of the bag except when stretched or drawn apart.

The fastener 24 can, with great strength and effort, be opened by drawing the upper edges of the bag apart, or by pulling the flaps apart.

Figure 2:
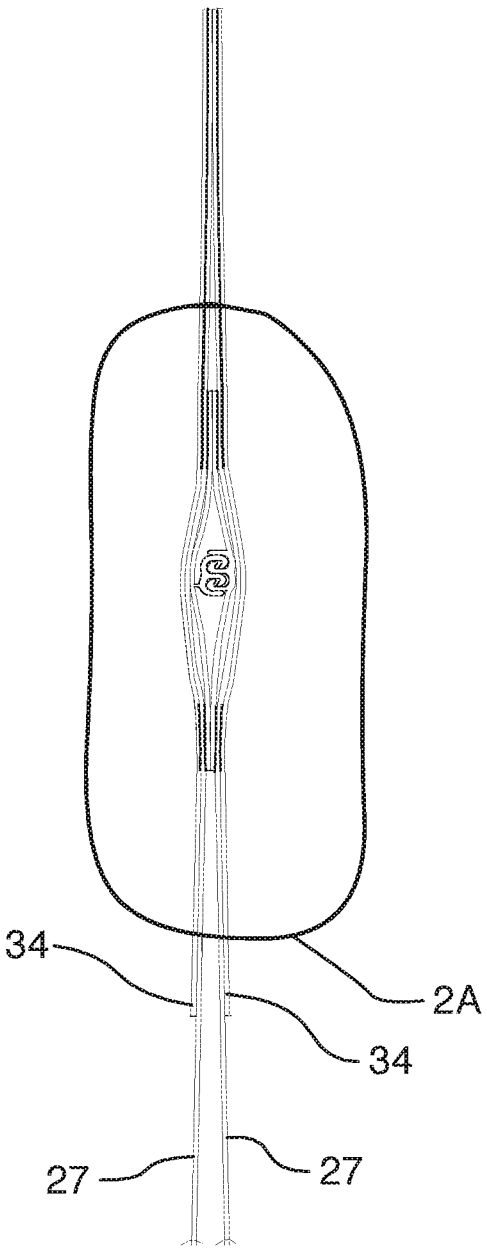
FIG. 2 is a view along section 2-2 of FIG. 1.
Figure 2A:
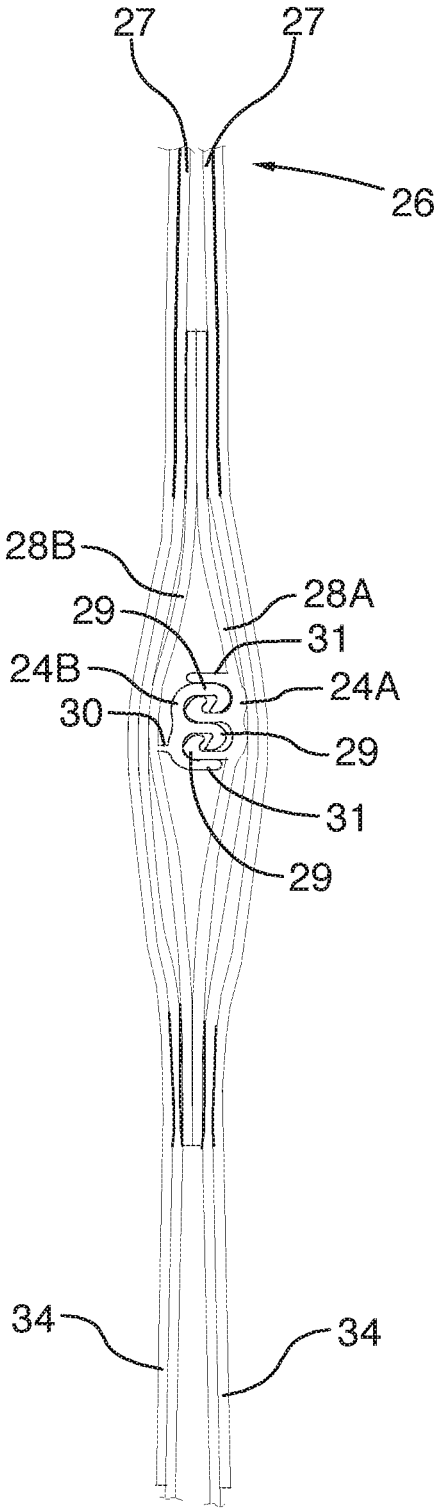
FIG. 2A is an enlarged view of encircled structure 2A of FIG. 2.
Figure 3:
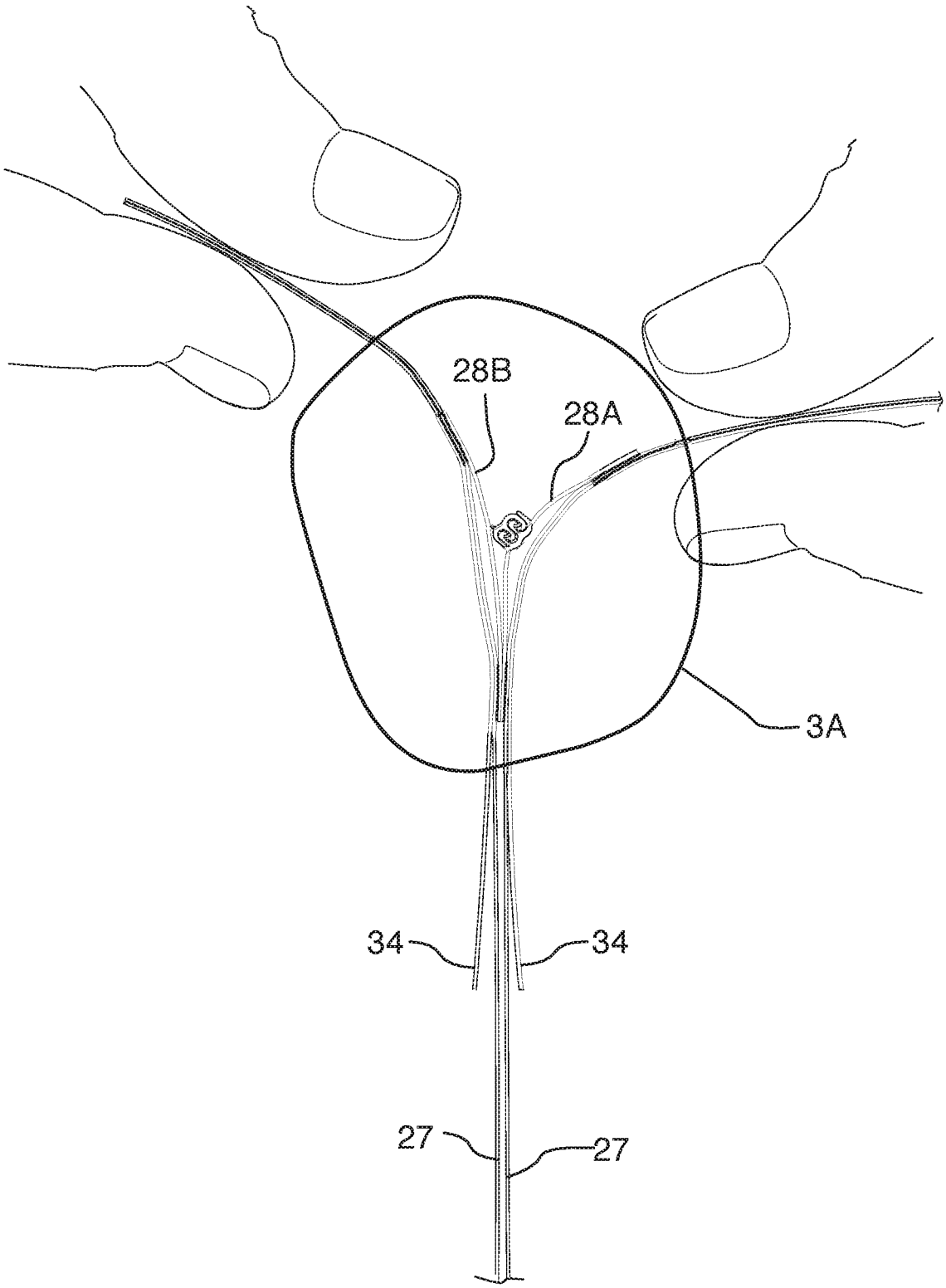
FIG. 3 is a view similar to FIG. 2 showing the walls of the bag, at the upper edge, drawn apart from one another.
Figure 3A:
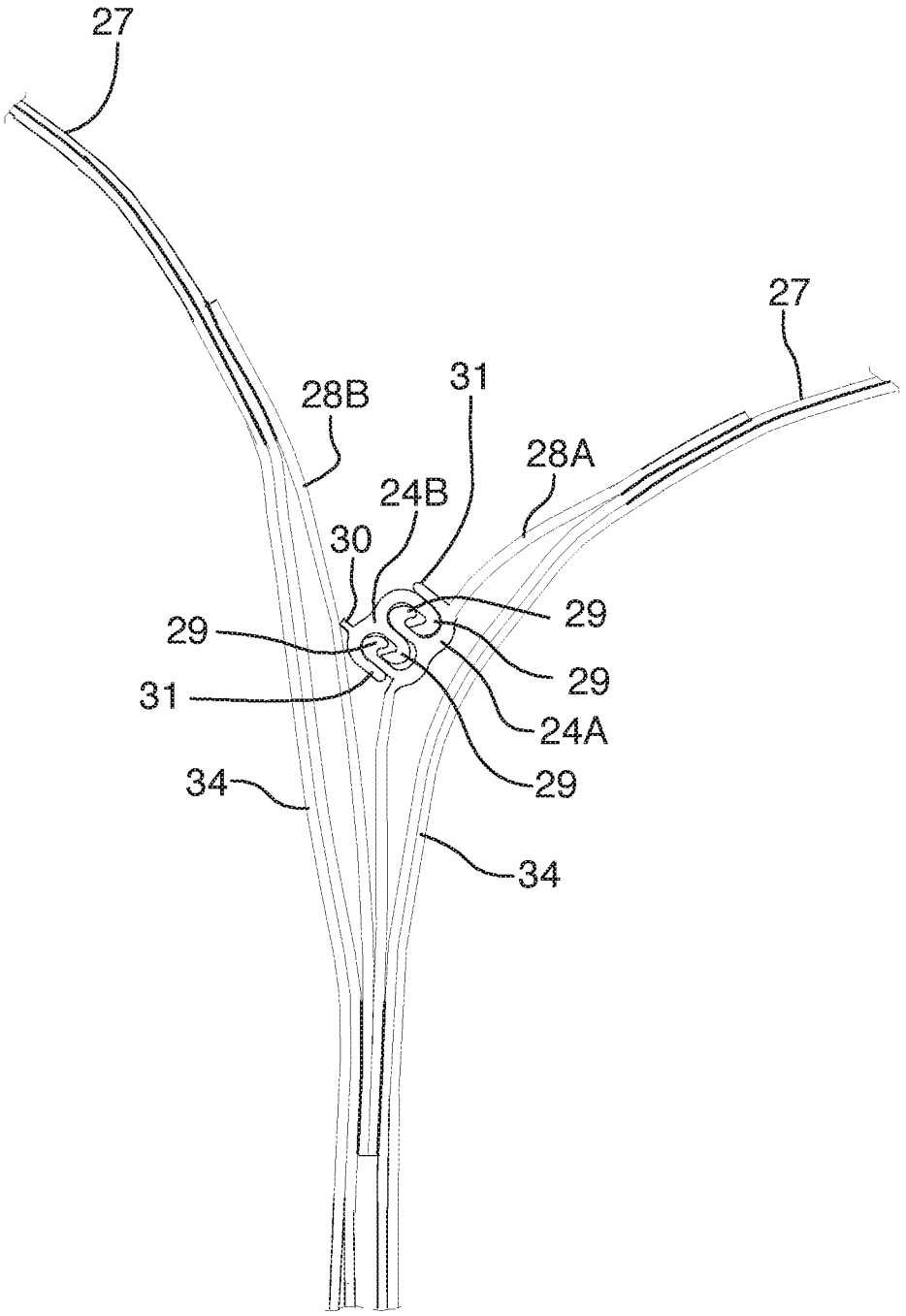
FIG. 3A is an enlarged view of encircled structure 3A of FIG. 3.
Figure 4:
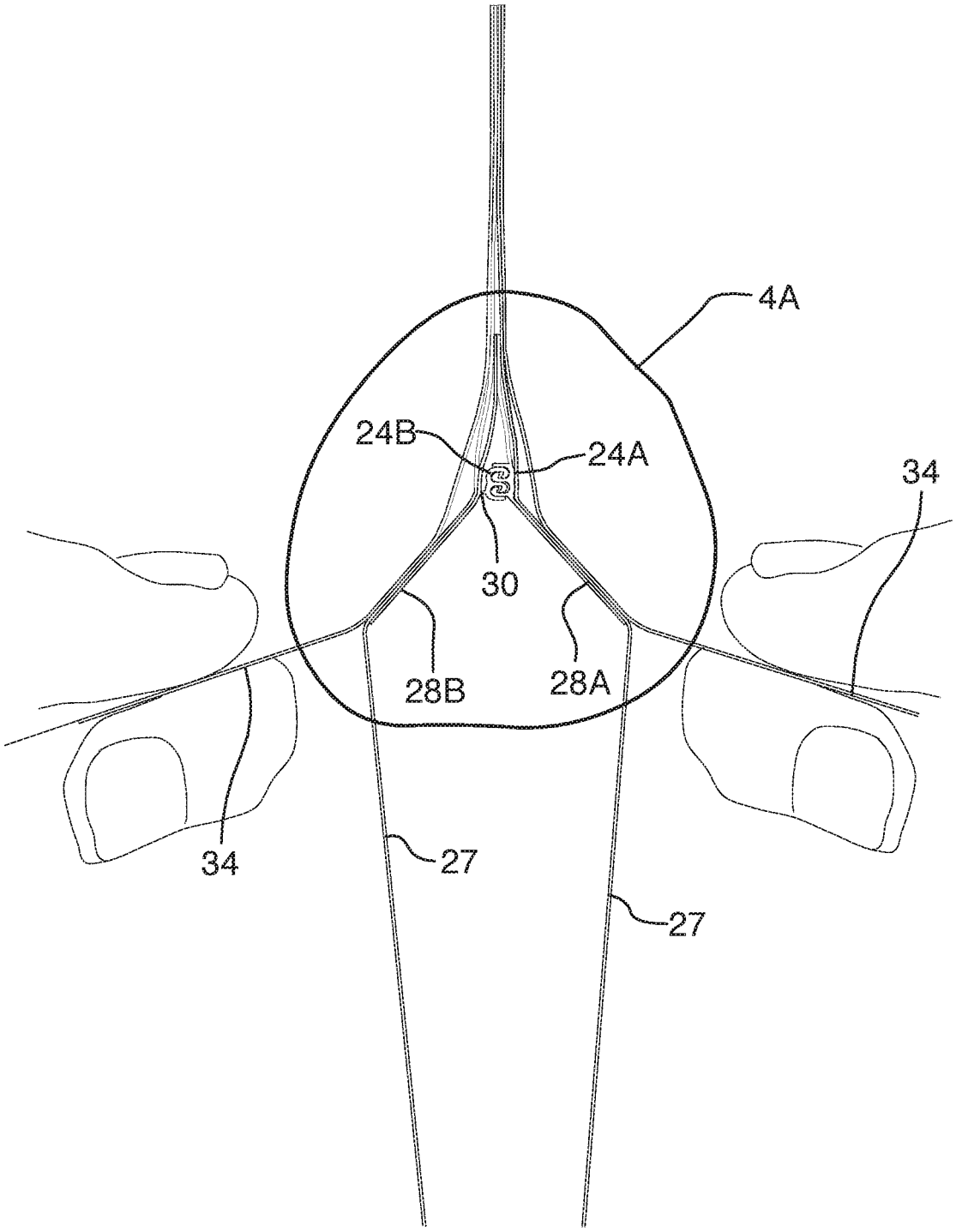
FIG. 4 is a view similar to FIG. 3 showing the flaps of the bag drawn apart by the edges.
Figure 4A:
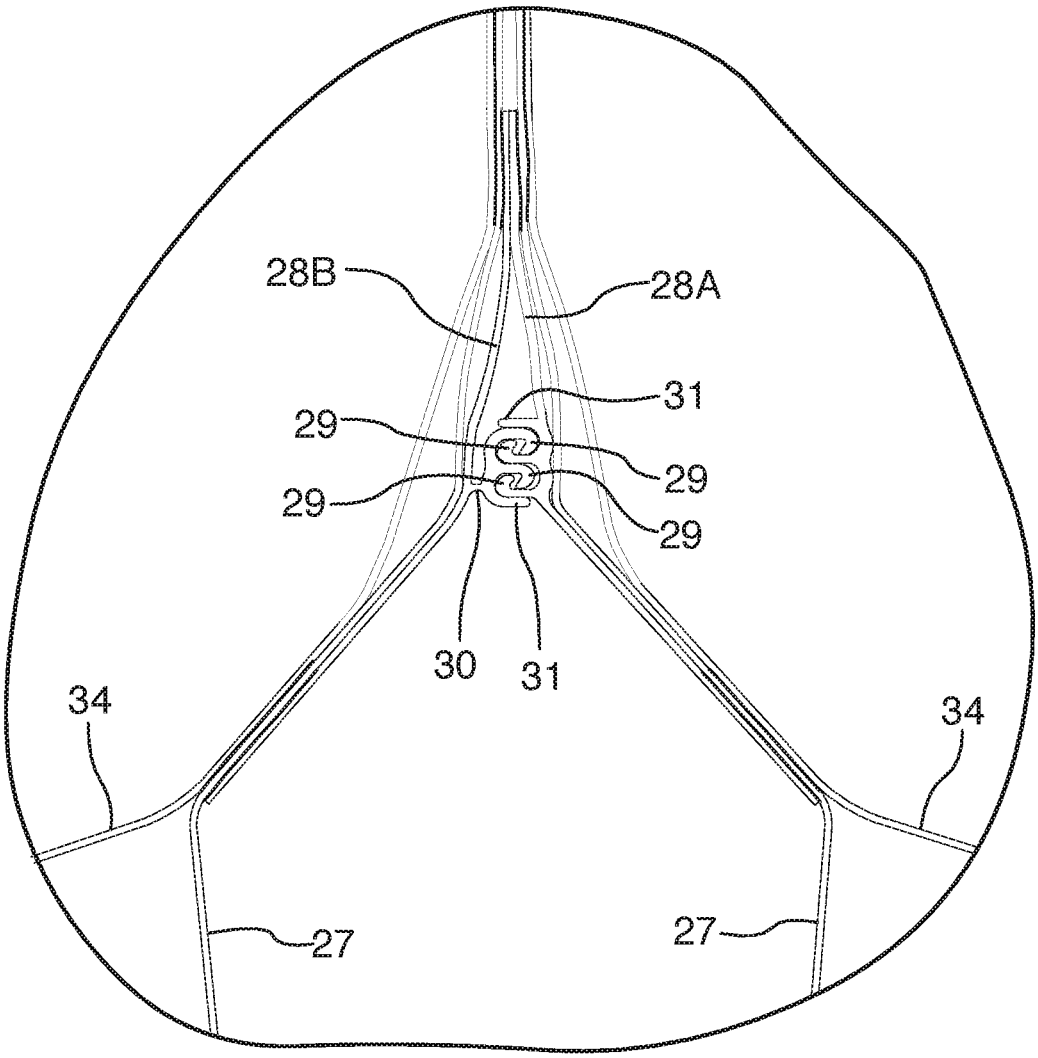
FIG. 4A is an enlarged view of encircled structure 4A of FIG. 4.
Figure 5B:
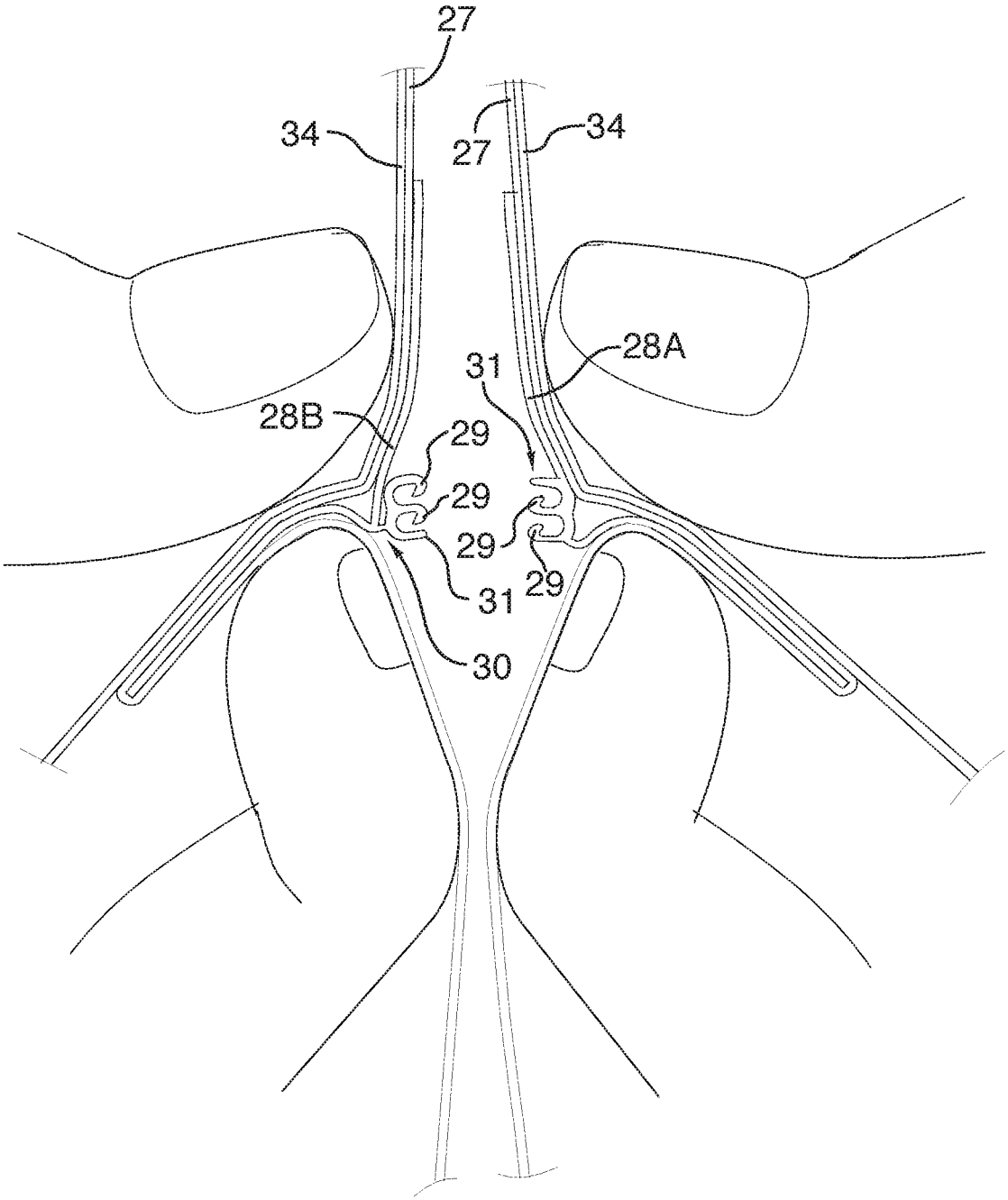

However, the application of modest levels of strength to the upper edge or the edges of the flaps does not unseal the closure:

modest force application to the upper edge is shown in the sequence of FIGS. 2A, 3A modest force application to the edges of the flaps is shown in the sequence of FIGS. 2A, 4A The only manner in which modest applications of strength unseal the bag is shown in the sequence of FIGS. 5A, 5B. Here, it will be seen that the user who forces the thumbs deeply into the bag, slightly doubling up the bag sides, to enable the thumbs to be positioned immediately adjacent the closure 24, can unseal the closure with a rotation motion.

The bag has been found to be compliant with SASTM D3476-16.

The walls 27 and closure 24 of the bag are constructed of material suitable to render the bag, when closed, opaque, moisture proof, odour proof, child resistant and sterile. A suitable material for the walls has been found to be a composite having a 2 mm polyethylene inner layer and a 0.5 mm metalized polyester outer layer.

Whereas a specific embodiment is herein shown and described, variations are possible.

For example, whereas a double hook closure is shown, single hook closures could be utilized.

As well, whereas a specific composite is mentioned, other films can be used.

Further, whereas a specific thumb-finger arrangement is described for closure, persons with sufficient dexterity have been known to open the bag with fingers inserted in the flaps and thumbs external to the flaps.

As well, whereas it will be evident to persons of ordinary skill that the bag will have utility in the context of drugs, other uses are possible.

Yet further, whereas a bag is shown, it will be appreciated that the invention could be embodied in a bag pre-form. For example, rather than having a closed bottom, as shown, the bottom could define an aperture and be adapted to be heated-sealed to form a bag from the perform, and could also be wicketed, such that the bags could be filled through the bottom, then heat-sealed and stripped from the wicket. In such event, the top of the bag perform could be heat sealed prior to filling, and frangible, to provide a tamper evident seal. FIG. 6 shows a bag of this type; the aperture is indicated by 100, the heat-sealed upper end is indicated by 102, a tear notch is indicated by 104 and the holes that allow for wicketing are indicated by 106.

It should also be appreciated that the bag can be constructed in a variety of ways. For example, as indicated in FIG. 7, the bag can be produced either on a pouch machine or a sideweld bag machine, indicated by 150.

A single web 110 can be fed over a series of rollers and formers 120 to make progressive folds 130, 130 and a zipper closure 140, 140 can be continuously fed to the inner side of the structure and sealed in place.

Side seals 160 are made intermittently to finish the bag 20. The seal on a sideweld version can be a bead seam whereas on the pouch machine the seal can be up to ¼" wide.

Accordingly, the invention should be understood to be limited only by the accompanying claims, purposively construed.

The invention claimed is:

1. An improved resealable bag preform of the type having:

a bottom defining an aperture and which is adapted to be sealed to form a bag from the preform;

a pair of walls extending from the bottom, each defining a side of the bag, the walls being joined to one another to define a pair of spaced apart side edges of the bag between which side edges the walls each extend;

an upper edge to which the walls extend; and for each of the walls and operatively secured thereto, proximal to and spaced from the upper edge, a component, the components mating with one another to define a recloseable press-to-seal fastener, the improvement comprising:

each component having a pair of hooks and a barrier;

one of the components being arranged such that the barrier lies between the hooks and the upper edge and such that the hooks open towards the upper edge;

the other of the components being arranged such that the hooks lie between the barrier and the upper edge and such that the hooks open away from the upper edge;

the hooks and barriers being shaped and dimensioned such that, when the components are mated, to occlude the bag:

the spaces between the hooks and the barrier of the one component are substantially occupied by the hooks of the other component; and the spaces between the hooks and the barrier of the other component and substantially occupied by the hooks of the one component;

one of the components being operatively connected to the bag by a flexible flange to allow for hinged movement of the one of the components relative to the bag, the other of the components being restrained against hinged movement;

the components being shaped and dimensioned such that, when the components are mated, to occlude the bag, a majority of the components are positioned between the flange and the upper edge; and, the resealable bag preform further comprising for each side of the bag, a flap, the flap having side edges that are sealed to the side edges of the bag, the flap being sized and dimensioned such that the flap lies flush against the side of the bag except when stretched or drawn apart therefrom, the flap being disposed intermediate the recloseable fastener and the bottom, wherein the fastener is adapted such that the amount of force necessary to separate the components, when such force is applied to folded interior portions of the walls at a position adjacent the fastener, such force is substantially less than the amount of force necessary to separate the components when such force is applied to the free edges of the flaps.

2. The resealable bag preform according to claim 1, further comprising, for each wall of the bag, a strip, the strip extending between the side edges of the bag and having a pair of edges, each edge extending between the side edges of the bag and being secured to the wall.

3. The resealable bag preform according to claim 2, wherein each component is secured to the wall for which it is provided by attachment to the strip provided for said each wall.

4. The resealable bag preform of claim 3, wherein the component is disposed in offset relation between the edges of the strip such that it is further from the edge of the strip that is nearest to the bottom of the bag.

5. The resealable bag preform of claim 4, wherein the strip, but for the edges thereof, is distinct and separable from the side of the bag to which it is attached.

6. The resealable bag preform of claim 1, wherein the other of the components arranged such that the hooks lie between the barrier and the upper edge and such that the hooks open away from the upper edge is the one of the components one of the components operatively connected to the bag by a flexible flange.

* * * * *